US006010419A

United States Patent [19]

Rappaport et al.

[11] Patent Number: 6,010,419

[45] Date of Patent: Jan. 4, 2000

[54] THROWING TOY WITH NON-SPINNING TAIL

[75] Inventors: Mark J. Rappaport, San Diego, Calif.; Jose E. Leal, Maynard, Mass.; Thomas H. Grimm, Menlo Park, Calif.; Arne Lang-Ree, Los Gatos, Calif.; Ron LaRonge, San Jose, Calif.

[73] Assignee: OddzOn, Inc,, Napa, Calif.

[21] Appl. No.: 08/926,951

[22] Filed: Sep. 10, 1997

[51] Int. Cl.[7] ..... A63B 43/00

[52] U.S. Cl. ..... 473/613

[58] Field of Search ..... 473/570, 575, 473/576, 578, 579, 580, 581, 582, 585, 586, 596, 613

[56] References Cited

U.S. PATENT DOCUMENTS

| | | |
|---|---|---|
| 23,538 | 4/1859 | Arnold . |
| D. 288,216 | 2/1987 | Jensen . |
| D. 306,894 | 3/1990 | DeMarco . |
| D. 346,001 | 4/1994 | Stillinger et al. . |
| D. 348,907 | 7/1994 | Prentice et al. . |
| D. 350,577 | 9/1994 | Giudice . |
| D. 355,460 | 2/1995 | Routzong et al. . |
| D. 361,811 | 8/1995 | Grimm et al. . |
| 1,293,869 | 2/1919 | Murray et al. . |
| 1,296,403 | 3/1919 | Kindle . |
| 1,520,131 | 12/1924 | Jacob . |
| 1,718,508 | 6/1929 | White . |
| 2,183,152 | 12/1939 | Prensky et al. . |
| 2,338,719 | 1/1944 | Holt . |
| 2,432,209 | 12/1947 | Osgood . |
| 2,494,026 | 1/1950 | Anderson . |
| 2,608,027 | 8/1952 | Perker et al. . |
| 2,611,999 | 9/1952 | Mikolay . |
| 2,759,297 | 8/1956 | Lewis . |
| 2,763,958 | 9/1956 | Lemelson . |
| 2,870,570 | 1/1959 | Benson . |
| 3,147,011 | 9/1964 | Lemelson . |
| 3,190,654 | 6/1965 | Ross . |
| 3,198,526 | 8/1965 | Smith et al. . |

(List continued on next page.)

FOREIGN PATENT DOCUMENTS

| | | |
|---|---|---|
| 900310 | 12/1953 | Germany . |
| 469863 | 9/1937 | United Kingdom . |

*Primary Examiner*—Steven Wong

*Attorney, Agent, or Firm*—Kolisch Hartwell Dickinson McCormack & Heuser

[57] ABSTRACT

A throwing toy is provided which is adapted to be thrown by a user for a flight through the air along a flight path. The toy includes a football-shaped head portion, generally centered about a longitudinal axis, an elongate tail portion extending axially rearward the head portion along the longitudinal axis, and a coupling, which interconnects the head and tail portions and allows the portions to be movable relative to each other, particularly to be rotatably movable about the longitudinal axis. Because the head portion and tail portion can rotate relative to each other, the user can hold the head portion in the hand and throw the toy through the air, imparting a spin to head portion causing it to rotate about its longitudinal axis throughout the flight. At the same time, the tail portion remains substantially fixed throughout the flight with respect to the longitudinal axis because the spin imparted to the head portion is substantially isolated from the tail portion by the rotatable coupling. The coupling includes a shaft and a bearing tube which receives the shaft and substantially locks the shaft in place against movement along the longitudinal axis while allowing rotation about the longitudinal axis. The head portion is fixed about the bearing tube and the tail portion is fixed about the shaft. Head portion is formed of polyurethane foam directly around the bearing tube by holding the bearing tube in a mold and injecting and curing the foam around the bearing tube. The in-flight football realizes the benefits of spiraling, namely, accuracy and stability. Simultaneously, the non-spinning fins provide stabilizing and gliding effects, further augmenting the flight-enhancement provided by spiraling. The fins do so without the resistance or turbulence inherent in spinning fins.

21 Claims, 3 Drawing Sheets

U.S. PATENT DOCUMENTS

| | | | |
|---|---|---|---|
| 3,225,488 | 12/1965 | Goldfarb . | |
| 3,256,020 | 6/1966 | Smith . | |
| 3,292,879 | 12/1966 | Chilowksy . | |
| 3,437,340 | 4/1969 | Grise . | |
| 3,528,662 | 9/1970 | Merchant et al. . | |
| 3,746,334 | 7/1973 | Stubblefield . | |
| 3,909,976 | 10/1975 | Kirk . | |
| 4,019,738 | 4/1977 | Tong | 473/580 |
| 4,021,041 | 5/1977 | Goldfarb et al. . | |
| 4,088,319 | 5/1978 | Clarke . | |
| 4,112,613 | 9/1978 | Toplak . | |
| 4,294,447 | 10/1981 | Clark . | |
| 4,335,537 | 6/1982 | Walker . | |
| 4,336,936 | 1/1983 | Ferguson . | |
| 4,339,138 | 7/1982 | Di Manno . | |
| 4,366,936 | 1/1983 | Ferguson . | |
| 4,531,737 | 7/1985 | Jacobson et al. . | |
| 4,537,405 | 8/1985 | Cymbler . | |
| 4,657,253 | 4/1987 | Lerner et al. . | |
| 4,736,948 | 4/1988 | Thomas . | |
| 4,842,285 | 6/1989 | Farler | 473/585 |
| 4,930,777 | 6/1990 | Holenstein . | |
| 4,943,066 | 7/1990 | Lathim et al. . | |
| 4,946,172 | 8/1990 | Wong | 473/585 |
| 4,958,838 | 9/1990 | Farler | 473/586 |
| 4,978,130 | 12/1990 | Farler | 473/586 |
| 5,066,017 | 11/1991 | Kurland . | |
| 5,112,062 | 5/1992 | Pratt | 473/585 |
| 5,228,690 | 7/1993 | Rudell et al. . | |
| 5,267,735 | 12/1993 | Bushman . | |
| 5,269,514 | 12/1993 | Adler et al. . | |
| 5,284,341 | 2/1994 | Routzong et al. . | |
| 5,779,576 | 7/1998 | Smith, III et al. | 473/613 |
| 5,807,198 | 9/1998 | Grimm | 473/613 |

THROWING TOY WITH NON-SPINNING TAIL

BACKGROUND OF THE INVENTION

The present invention relates generally to toy throwing balls. More particularly, it is directed to a toy throwing ball with a main ball-shaped body trailed by a non-spinning tail, where the ball-shaped body rotates in flight relative to the tail, increasing flight stability and reducing drag.

Throughout the prior art, fins have been used on various kinds of flying toys to increase flight stability, accuracy, and distance. These fins typically extend outwardly from the toy, spaced-apart around a longitudinal axis. Often the fins are mounted on a shaft extending rearwardly from the toy. Flying toys as diverse as a golf ball (U.S. Pat. No. 2,432,209), a toy rocket (U.S. Pat. No. 2,759,297), a blow dart (U.S. Pat. No. 3,190,654), a toy javelin (U.S. Pat. No. 4,021,041), and a suction cup dart (U.S. Pat. No. 5,066,017) have been designed with fins.

The prior art also reflects endeavors to improve upon the flying performance of a football by adding a tail, with or without fins, to help the football fly straight. A normal football has an inherent instability, caused by the center of pressure's being forward of the center of gravity, giving the football a natural tendency, when thrown along a flight path, to tumble end over end. This natural tendency has been countered in the past by two methods. One is spiraling the football, which is imparting a spin or rotation about the football's longitudinal axis as the football is thrown. The spin provides a gyroscopic effect that tends to keep the nose of the football pointed in a constant direction. However, the spin is often insufficient to overcome the football's inherent instability completely and the football rocks during flight about a pitch and a yaw axis. Such rocking can also be described as a circular movement of the football's nose about the flight path. The rocking increases the effective frontal cross-section of the football, thus increasing drag and shortening the flight's length.

The other method for improving the football's stability is to add a tail, especially one with fins. The addition of the tail moves both the center of pressure and the center of gravity of the combined football-and-tail rearward as compared to the football alone. However, the greater surface area-to-weight ratio of the finned tail, as compared to the football, moves the center of pressure farther rearward, ideally to a position aft of the center of gravity which provides inherent stability. However, known tail configurations can actually degrade flight quality by increasing drag unnecessarily and resisting spin.

Various attempts have been made to increase and improve upon football stability through diverse tail-end fin configurations, some of which also attempt to allow for spin. For example, U.S. Pat. No. 3,225,488 discloses a football with four fins, where one fin is angularly displaced to increase rotation. However, as pointed out in U.S. Pat. No. 5,269,514, the three straight-ahead fins of the four-finned football of the '488 patent counter the effect of the angularly-displaced fin so that the four-finned football spins less than an unaltered football. U.S. Pat. No. 5,269,514 also discloses a finned football having two angled, curved fins configured to cause spin.

Although curving, angled fins extending beyond the body of the ball may increase spin, they come with disadvantages. Because the fins are curved and angled relative to the desired flight path, the fins resist air flow moving over the ball. Indeed, it is this very resistance which imparts the spin to the ball. But, the resistance also decreases the forward velocity of the ball. Furthermore, the fins are necessarily configured to increase spinning only in one direction while opposing spinning in the opposite direction. Thus, each ball with the curving, angled fins can be properly thrown only by a left-handed person, or only by a right-handed person, depending on which direction the fins are oriented. Additionally, the spinning fins are believed to create a zone of turbulence which trails the ball, further acting as a resistive force. The combination of fin resistance and turbulence trailing the ball work together to sap the ball's forward velocity, thereby decreasing flight potential.

To overcome the drawbacks and limitations associated with existing techniques for providing stable and extended toy ball flight, it is an object of the present invention to provide a toy ball with a non-spinning tail, where the ball rotates in flight relative to the tail, thus enabling both advantages of spin-assisted stability and tail-assisted stability.

Another object of the present invention is to provide a toy ball with a non-spinning tail that allows the thrower to spiral the ball easily and naturally.

It is another object of the present invention to provide a toy ball with a non-spinning tail, where the ball spirals without the resistance and turbulence created by spinning fins.

Yet another object of the present invention is to provide a toy ball with a non-spinning tail that utilizes the stabilizing and gliding advantages of non-spinning fins.

One more object of the present invention is to provide a toy ball with a non-spinning tail that combines the flight accuracy and stability advantages resulting from spiraling with the flight stability and gliding advantages provided by tail fins.

It is another object of the present invention to provide a toy ball with a non-spinning tail which is made from a soft, foamed plastic material, making the toy safe and suitable for younger children.

Yet another object of the present invention is to provide a method for manufacture of a toy ball with a non-spinning tail which allows the toy to be produced inexpensively and to be assembled easily.

These and other objects and advantages of the invention will be more clearly understood from a consideration of the accompanying drawings and the following description of the preferred embodiment.

SUMMARY OF THE INVENTION

The present invention is a throwing toy, including a head portion, a tail portion, and a coupling rotatably joining the head and tail portions. That is, the coupling is configured so that the head portion and the tail portion can rotate relative to each other about a common longitudinal axis. The present invention also includes a method for manufacturing the throwing toy, including forming the head portion, forming an elongate tail portion, and rotatably connecting the head portion to the tail portion such that the head portion and the tail portion can rotate relative to each other.

DETAILED DESCRIPTION OF THE PREFERRED EMBODIMENT

Figure 4:
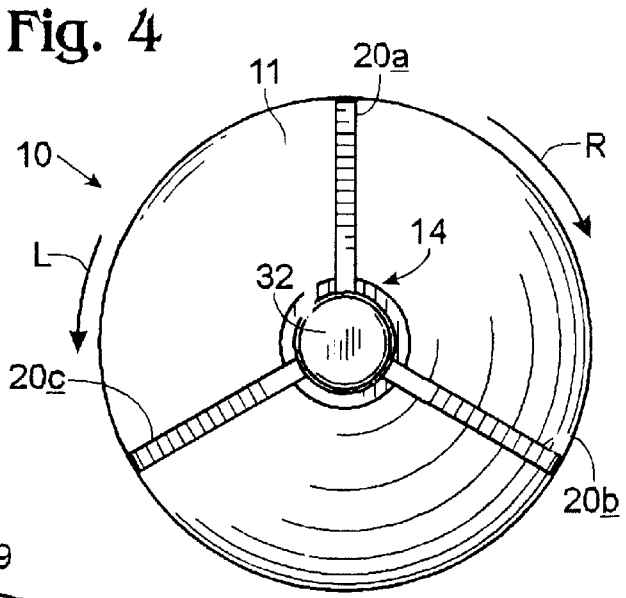
FIG. 4 is a rear view of the toy of FIG. 1 showing rotational directions for the head portion.
Figure 1:
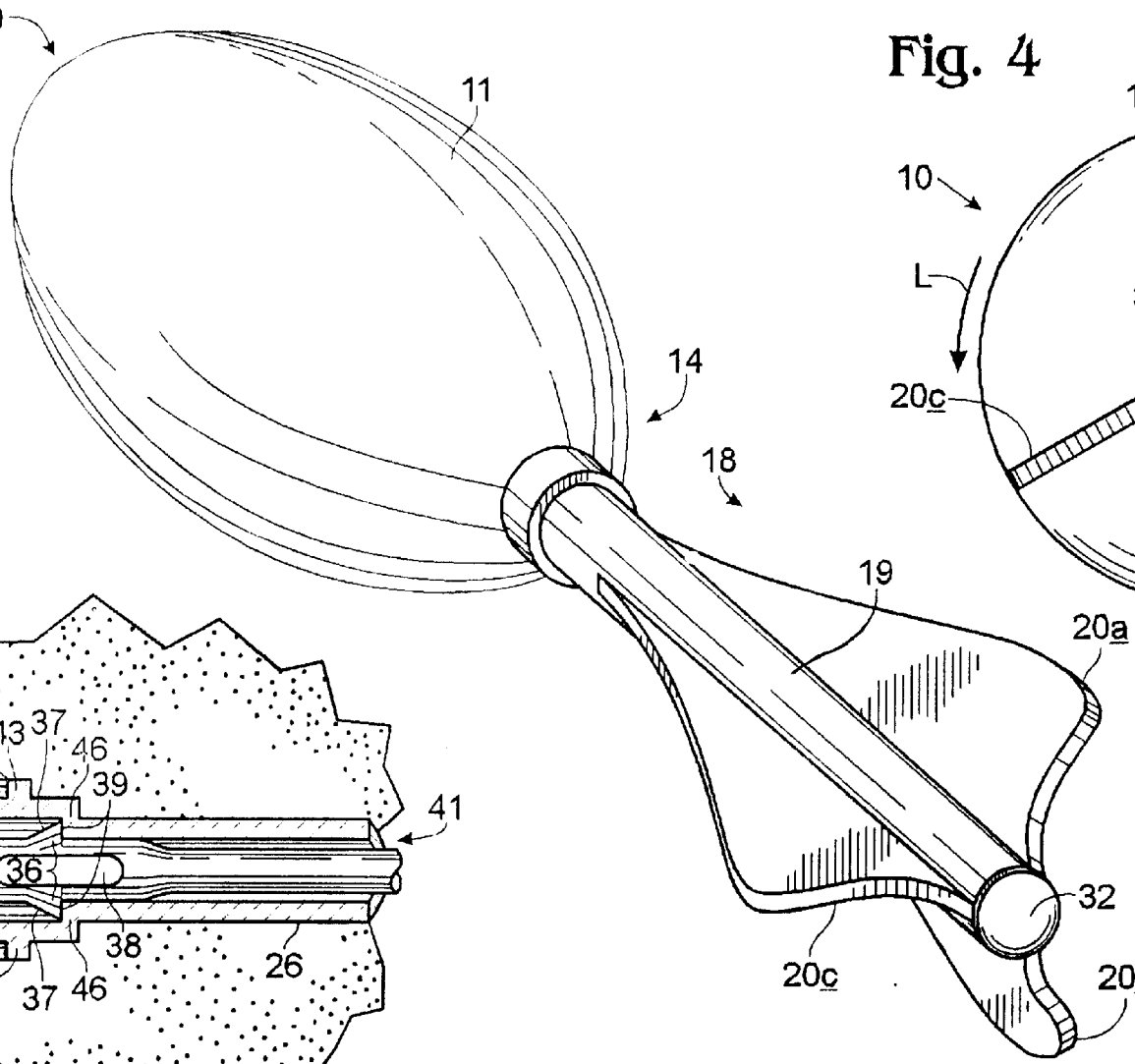
FIG. 1 is a perspective view of a throwing toy constructed according to the invention showing a football-shaped head portion and a finned tail portion.
Figure 2:
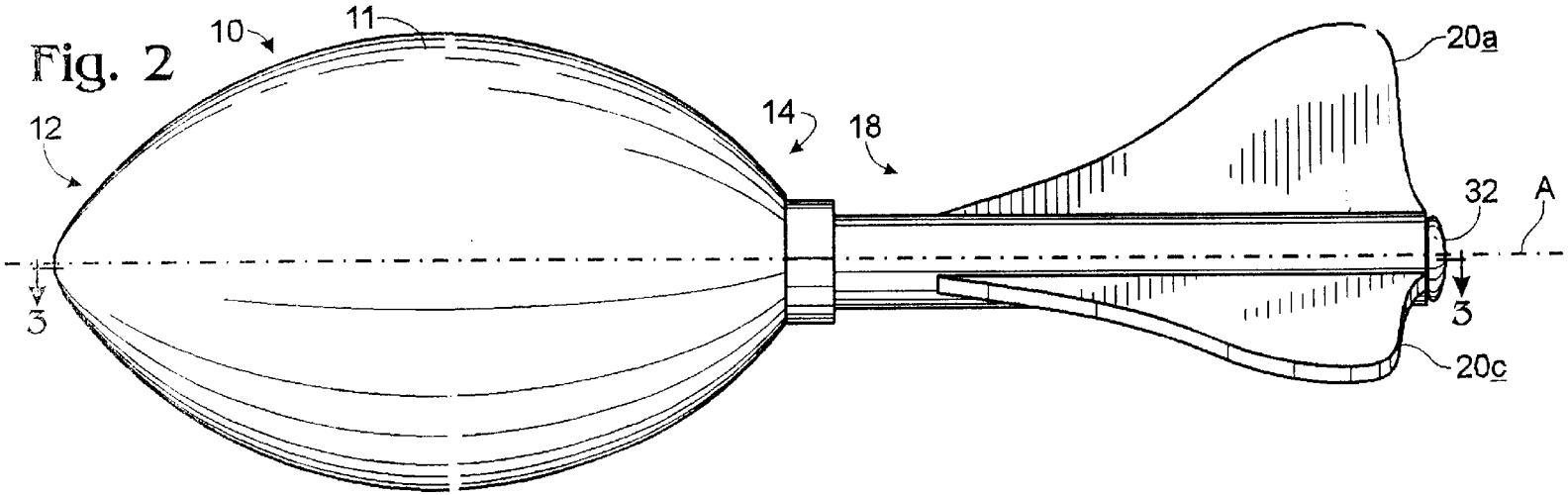
FIG. 2 is a side elevation view of the toy of FIG. 1 showing the scalloped, triangular shape of the tail fins.

An embodiment of the present invention is shown generally at 10 in FIGS. 1, 2, and 4. The invention is a throwing toy adapted to be thrown by a user for a flight through the air, the flight beginning as the toy is accelerated in, and released from, the user's hand and ending when the toy either is caught by another user or strikes the ground. Referring to FIG. 1, in the disclosed embodiment, the throwing toy includes a head portion, such as football-shaped ball 11. In the disclosed embodiment, head portion 11 has a tapered front end, indicated generally at 12, and a tapered rear end, indicated generally at 14. However, in alternative embodiments, the head portion may be any other type of ball or throwing device, including an elongate ball with one tapered end and one semi-spherical end.

Figure 3:
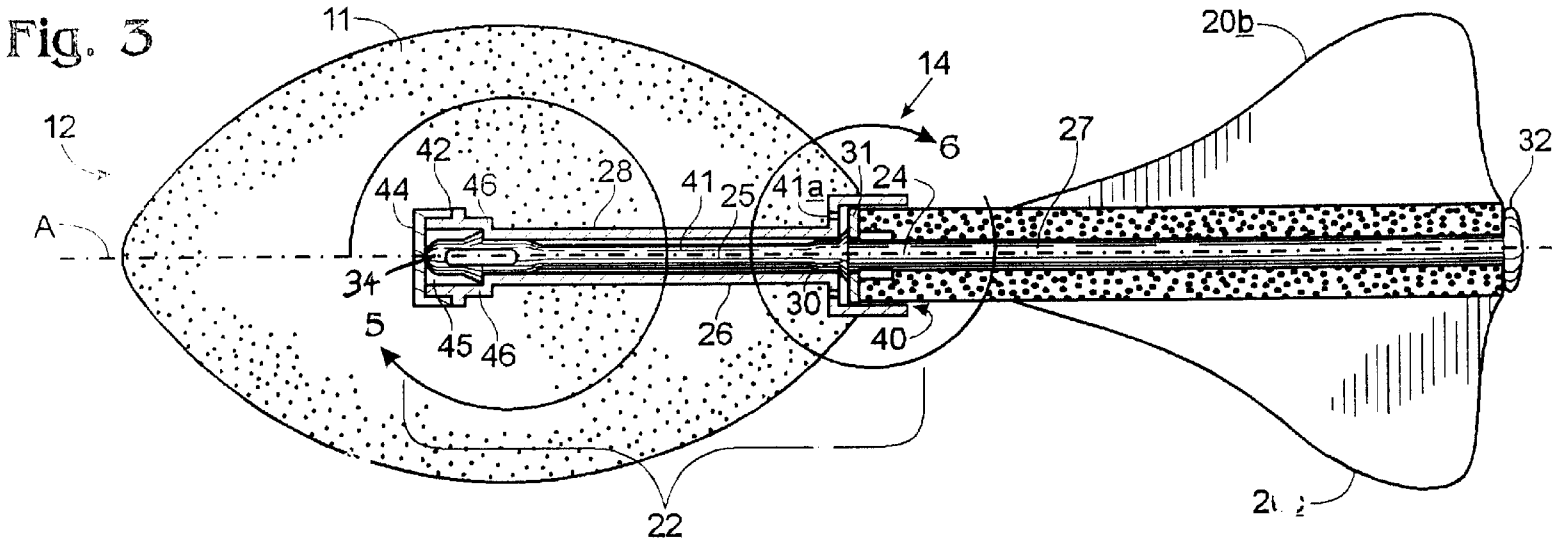
FIG. 3 is a cross-sectional view of the toy of FIG. 1 showing a bearing tube fixed within the head portion and a shaft with an internal portion held rotatably within the bearing tube and an external portion extending rearwardly from the head portion and holding the tail portion.

Front end 12, rear end 14, and head portion 11 are generally centered about a longitudinal axis A, represented by the dash-dot line shown in FIGS. 2 & 3. Head portion 11 has a shape that is generally symmetric about axis A and is preferably constructed to be sufficiently rigid to maintain substantially its shape throughout each flight of the toy. Ideally, head portion 11 is made at least partially from a foam material, preferably polyurethane foam, which is durable and soft enough to be easy to catch and safe even for younger children.

The throwing toy also includes an elongate tail portion, indicated generally at 18, which extends axially rearward from rear end 14 along longitudinal axis A. Tail portion 18 includes an elongate, generally cylindrical member 19, preferably made of extruded polyethylene foam, and three fins 20*a*, 20*b*, and 20*c*, die-cut from a sheet of extruded polyethylene foam and adhesively bonded to member 19. Member 19 extends along, and is generally centered about, axis A and fins 20*a–c* extend radially outward from member 19. The three fins are preferably evenly spaced-apart around longitudinal axis A at angles of approximately 120 degrees. However, in alternative embodiments, there may be a greater or lessor number of fins, spaced-apart around the longitudinal axis at various intervals. Although fins 20*a*, 20*b*, and 20*c*, as best seen in FIG. 2, are roughly triangular fins with a scallop removed at a rear edge, in alternative embodiments they might be curved, right-triangular, square-shaped, half-circle shaped, or any one or more of numerous other designs. Preferably, tail portion 18 is constructed to be durable and sufficiently rigid to maintain its shape throughout the flight of the ball, while yet being soft enough to be safe, as with polyethylene foam.

Tail portion 18 and head portion 11 are movably coupled together by a coupling, shown generally at 22 in the cross-sectional view in FIG. 3, which allows the head and tail portions to be movable relative to each other. Coupling 22 rotatably connects, or joins, head portion 11 and tail portion 18 together allowing relative rotation about longitudinal axis A. Coupling 22 includes a shaft, such as elongate plastic dowel 24, and a receptor, such as elongate plastic socket or bearing tube 26. As shown in FIG. 3, shaft 24 includes an insertion portion 25 that is received in receptor 26 and an external portion 27 to which tail portion 18 is rigidly connected. Alternatively, the disposition of shaft and receptor could be reversed with the receptor fixed within the tail portion, e.g., within cylindrical member 19, and the shaft rigidly coupled to, and extending from, the head portion, so long as the shaft is rotatable relative to the receptor and, thus, the head portion is rotatable relative to the tail portion.

Receptor 26 is fixed within a cavity 28 in head portion 11 that extends from rear end 12 slightly more than halfway towards front end 14 and is centered about longitudinal axis A of head portion 11. Receptor 26 includes a flared opening 40 at rear end 14 of head portion 11, and an elongate channel 41 interconnecting opening 40 with a closed end 42 located roughly at the center, or slightly forward of the center, of head portion 11. Closed end 42 is formed by the connection of a head cap 44 over an open end 45 of channel 41. Head cap 44 is held in place by any suitable means, such as gluing to a flange 43 (FIG. 5) on open end 45. Flange 43 includes two guide pins 43*a* and 43*b* which mate with holes in cap 44, improving the joint between cap 44 and open end 45. Closed end 42 is formed with a cap rather than as a unitary structure because the separate shapes of the end cap and the elongate channel can be readily molded of plastic. Closed end 42 includes a circumferential, internal abutment shoulder 46, which extends perpendicularly relative to the long axis of the socket.

Figure 5:
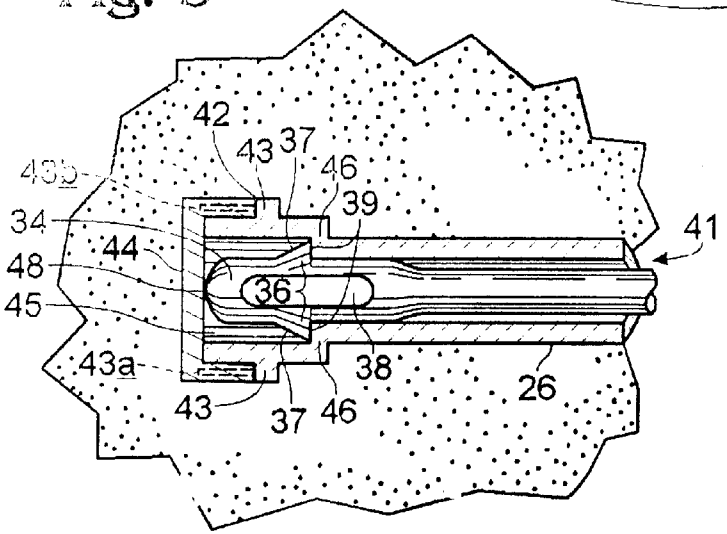
FIG. 5 is an enlarged view of the bearing tube within the head portion and a head of the shaft which snaps into place in a closed end of the bearing tube.

Shaft 24 includes a retaining structure, such as shaft head 34, as shown in FIG. 5, for forming a locking connection with receptor 26, thereby preventing the shaft from sliding out of the receptor. Shaft head 34 includes a radial slot 38 and two shaft head catches 36, one on each of two sides of slot 38. Each catch 36 has an insertion side 37, facing forward and angled relative to shaft 24, and a retention side 29 facing aft and perpendicular to the shaft. Shaft 24 and receptor 26 are joined together by inserting shaft head 34 in an insertion direction into and past the flared opening 40 of the receptor. Shaft head 34 then enters channel 41.

Although shaft head 34 at the location of catches 36 has a greater cross-sectional dimension than the interior dimension of channel 41, shaft head 34 can be inserted into and through channel 41 because insertion sides 37 of catches 36 are angled relative to the direction of insertion, and slot 38 allows shaft head 34 to collapse or deform elastically. The deforming is aided by the mechanical advantage of the angle of insertion side 37, so that shaft head 34 may shrink to the interior dimension of channel 41 and pass through the channel. Once shaft head 34, in its deformed state due to insertion into receptor 26, passes abutment shoulder 46 and enters closed end 42, it returns to its original shape and dimension because the closed end has a larger cross-sectional dimension than channel 41 and does not constrict shaft head 34.

With shaft head 34 snapped into position in closed end 42, retention side 39 of catch 36 abuts shoulder 46, as shown in FIGS. 3 and 5, preventing the shaft from moving back out of receptor 26 in a removal direction. Shaft head 34 is rotatable relative to receptor 26 and bears, when the head portion rotates relative to the tail portion, on cap 44 at shaft head tip 48 and on shoulder 46 at retention side 39. Shaft 24 is preferably molded using a polymer plastic such as polypropylene. Receptor 26 is preferably molded using a different polymer plastic such as acrylonitrile butadiene styrene or ABS. Both of these preferred plastics have a low coefficient of friction and the polypropylene is slightly softer than the ABS, yet still rigid enough to stiffen tail portion 18. Thus, the bearing surfaces of shaft 24 and receptor 26 are able to rotate with relatively little friction and the differential hardness causes the softer material to wear more than the harder material, which is believed to prevent binding of the bearing surfaces.

The longitudinally-locking arrangement of shaft head 34 and closed end 42 allows shaft 24 to rotate relative to receptor 26 while preventing shaft 24 from substantially sliding along its axis of rotation. The manufacturing tolerance of the parts requires that a small amount of play be allowed for, so the shaft 24 can be moved slightly along the longitudinal axis, but, it is substantially restrained. Of course, various other methods of engagement which allow a shaft to rotate relative to a socket, without sliding along its axis of rotation, are also within the scope of the invention.

Because receptor 26 is rigidly coupled to head portion 11, and shaft 24 is rigidly coupled to tail portion 18, the head portion and tail portion can rotate relative to each other. Thus, the user can hold head portion 11 in the hand and throw the toy through the air, imparting a spin to head portion 11 causing it to rotate about its longitudinal axis throughout the flight. At the same time, tail portion 18 remains substantially fixed throughout the flight with respect to the longitudinal axis because the spin imparted to head portion 11 is substantially isolated from tail portion 18 by rotatable coupling 22. Of course, since shaft head 34 and closed end 42 are in a frictional engagement, and because shaft 24 or member 19 may inadvertently contact receptor 26 during launch or flight, tail portion 18 may rotate about longitudinal axis A somewhat but still remain substantially fixed as compared to the spin imparted to head portion 11. As shown from the rear in FIG. 4, head portion 11 will rotate clockwise when thrown from the user's right hand, as indicated by arrow R, and counterclockwise when thrown from the user's left hand, as indicated by arrow L.

Figure 6A:
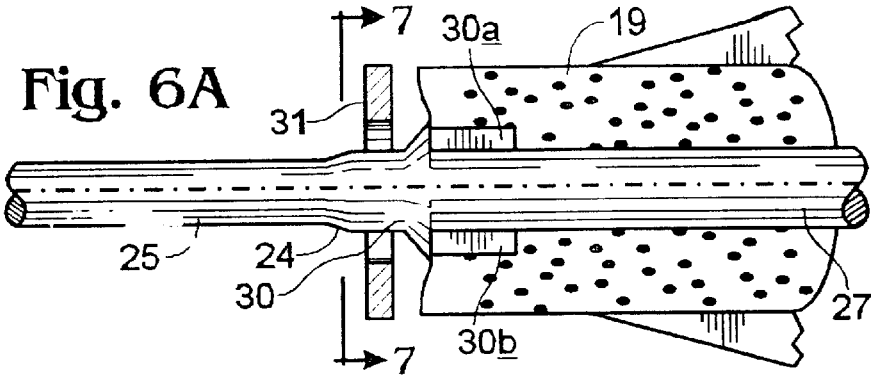
FIG. 6A is an enlarged view of the head portion and the tail portion in the tail region of the head portion, showing a lip on the shaft and a retaining ring being installed over the shaft head.
Figure 6B:
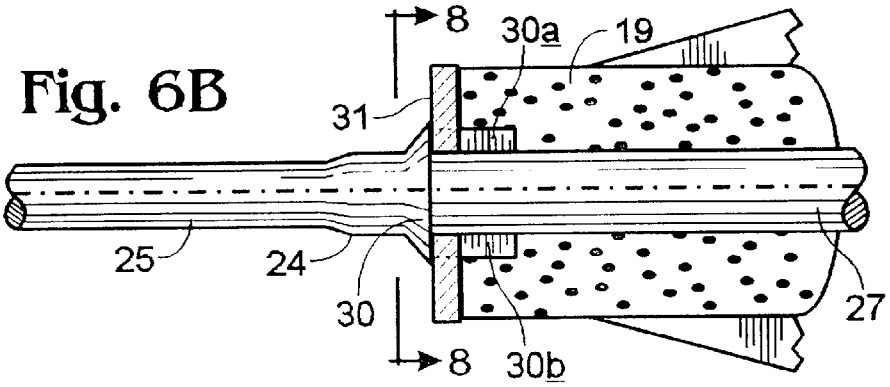
FIG. 6B is the enlarged view of the head portion as in FIG. 6A with the retaining ring locked into place at the lip where it compresses the tail portion slightly and keeps it clear of the bearing tube.

Manufacture and assembly of the present invention, in its preferred embodiment, is inexpensive and easy. As seen in FIG. 3, shaft 24 includes, at an end opposite to the shaft head, a restraining flange 32 and, roughly intermediate shaft head 34 and flange 32, a lip 30, both of which are integrally formed with shaft 24 as it is molded. Cylindrical member 19 is extruded with an inner hollow sized to fit over shaft 24. Member 19 is installed by pushing it over the shaft head and along the shaft until it is restrained by flange 32 in the final position best shown in FIG. 3. Member 19 is nominally long enough to extend from flange 32 to slightly beyond lip 31, as best seen in FIG. 6A. A bayonet-style retaining ring 31, preferably made of polypropylene, is then inserted over shaft head 24, as seen in FIGS. 6A and 6B.

Figure 7:
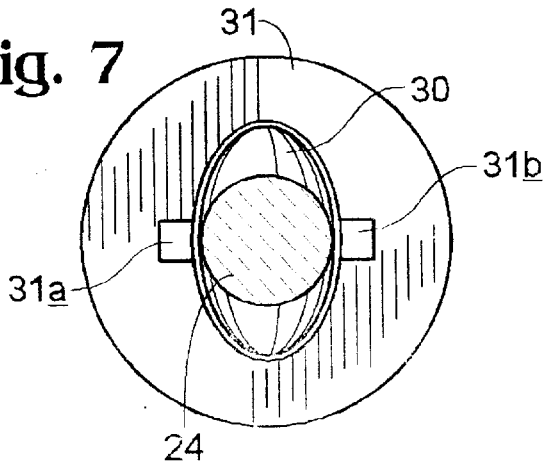
FIG. 7 is a cross-section of the shaft lip shown in FIG. 6A with the retaining ring positioned above the shaft lip as the ring is being moved down the shaft toward being locked into position at the shaft lip.
Figure 8:
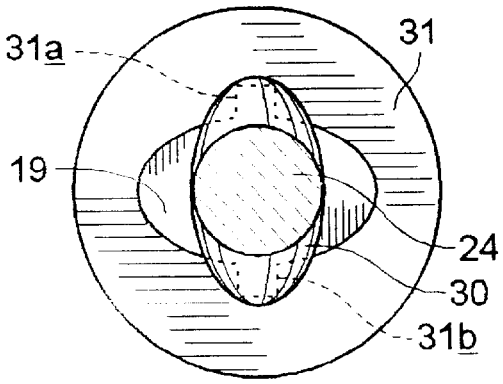
FIG. 8 is a cross-section of the shaft lip shown in FIG. 6B with the retaining ring shown locked into position at the shaft lip.

As best seen in FIGS. 7 and 8, ring 31 has a circular outer dimension slightly larger than that of member 19 and an ovoid internal opening. Lip 30 also has an ovoid cross-section slightly smaller than the opening in ring 31. When ring 31 is installed, the ovoid opening can be aligned with catches 36 and then lip 31 to pass the head and lip. With member 19 installed on the shaft, ring 31 compresses member 19 slightly as the ring is moved past lip 30 and past two key tabs 30*a* and 30*b*, which are also integrally formed on shaft 24. Ring 31 is then rotated 90° so that two notches 31*a* and 31*b* in ring 31 are aligned with key tabs 30*a* and 30*b* and the compression of member 19 then is allowed to push ring 31 into abutment with lip 30, the ovoid opening now being unaligned with lip 30 as shown in FIG. 8. Thus, tail portion 18 is fixed on shaft 24 and generally restrained against longitudinal motion and rotation about shaft 24. Tail portion 18 may also be adhesively bonded to shaft 24 to further affix the tail portion.

Since ring 31 is slightly bigger in outer dimension than member 19, ring 31, rather than member 19, will tend to come into contact with receptor 26 as shaft 24 bends slightly during launch and flight. This is preferable because the low-friction contact between the polypropylene of ring 31 and the ABS of receptor 26 couples head-portion spin to tail-portion spin much less than would contact between the polyethylene foam of member 19 and the ABS of receptor 19.

Head portion 11 is formed directly around receptor 26, with end cap 44 already glued to receptor 26, by inserting a steel rod (not shown) into channel 41 of receptor 26 and inserting the receptor into a polyurethane mold. A pair of guide pins (not shown) preferably attached to the rod and parallel to the rod are insertable into alignment holes 41*a* (FIG. 3) in receptor 26 to position the receptor as accurately as possible along the centerline of the mold. The receptor is held at the center of the mold while polyurethane foam is injected in an essentially liquid state. The foam is cured, with heating, around receptor 26 which is, thus, firmly held within head portion 11. Flange 43 and abutment shoulder 46 prevent withdrawal of receptor 26 from cavity 28. The toy is then finally assembled by inserting shaft head 34 into receptor 26 until it locks in place in closed end 42, as described above.

The present invention, according to its preferred embodiment as a football with a non-spinning tail, combines benefits normally associated with different types of flight-enhancing mechanisms. A thrower is able to spiral the football as if it were a normal football without fins, with no special handling required. The in-flight football realizes the benefits of spiraling, namely, accuracy and stability. Simultaneously, the non-spinning fins provide stabilizing and gliding effects, further augmenting the flight-enhancement provided by spiraling. The fins do so without the resistance or turbulence inherent in spinning fins.

It will now be clear that an improvement in this art has been provided which accomplishes the objectives set forth above. While a preferred embodiment of the invention and a preferred method of manufacturing it have been disclosed, it is appreciated that variations and modifications with respect thereto may be made without departing from the spirit of the invention.

I claim:

1. A throwing toy comprising:

a ball configured to spin during flight to increase stability and accuracy;

a tail portion configured to be substantially non-spinning during flight to reduce turbulence while providing increased stability during flight, wherein the ball and tail portion are made at least partially from a foam material; and a coupling rotatably connecting the ball to the tail portion.

2. The throwing toy of claim 1, wherein the head portion is elongate with tapered front and rear ends.

3. The throwing toy of claim 2, wherein the tail portion is coupled adjacent the ball's rear end.

4. The throwing toy of claim 1, wherein the tail portion includes a plurality of fins.

5. The throwing toy of claim 4, further comprising an elongate shaft, the fins being attached to the shaft.

6. The throwing toy of claim 1, wherein the coupling includes a shaft and a socket, the shaft extending into the socket and being rotatable relative to the socket.

7. The throwing toy of claim 6, wherein the shaft has a longitudinal axis about which the shaft is rotatable relative to the socket and wherein the shaft includes a retaining structure configured to form a locking connection with the socket so that the shaft is substantially restricted from moving along the longitudinal axis relative to the socket.

8. The throwing toy of claim 7, wherein the retaining structure of the shaft includes a deformable head including a catch, and the socket includes an abutment, the abutment being configured so that the head and catch are deformable to pass the abutment in an insertion direction, but, after passing the abutment, the catch and abutment substantially prevent movement of the shaft in a removal direction.

9. The throwing toy of claim 8, wherein the catch has a retention side substantially perpendicular to the shaft and an insertion side angled relative to the shaft, the surfaces being configured to allow easy insertion and unidirectional sliding of the shaft through the socket, while preventing the shaft from sliding out of the socket.

10. The throwing toy of claim 6, wherein the tail portion is coupled to the shaft so that the tail portion is substantially restricted from moving along the shaft.

11. The throwing toy of claim 10, wherein the tail portion has a front end and a back end and further comprising a pair of restraining members coupled to the shaft, each located adjacent one of the ends of the tail portion.

12. The throwing toy of claim 11 wherein at least one of the restraining members includes a lip integral to the shaft and a removable restraining ring, the ring abutting the lip.

13. The throwing toy of claim 6, wherein the socket is coupled to the ball.

14. A throwing toy having a longitudinal axis, the toy comprising:

an elongate ball having at least one tapered end and one other end, both ends being located on the longitudinal axis, the ball configured to spin during flight;

an elongate tail portion extending from one end of the ball along the longitudinal axis and configured to be substantially non-spinning during flight, wherein the ball and tail portion are made at least partially from a foam material;

a plurality of fins non-rotatably attached to the tail portion; and a coupling for rotatably connecting the ball to the tail portion such that the ball and the tail portion can rotate about the longitudinal axis relative to each other, and wherein the ball and tail portion are substantially prevented from moving along the longitudinal axis relative to each other.

15. A throwing toy adapted to be thrown for a flight through the air along a flight path, the toy comprising a ball and a tail portion, the ball and tail portion made at least partially from a foam material, the ball and tail portion movably coupled together, wherein the tail portion has a shape and the tail portion is sufficiently rigid to maintain substantially the shape throughout the flight of the toy and the ball and tail portion remain rotatable relative to each other throughout the flight but are substantially prevented from moving relative to each other along the flight path.

16. The throwing toy of claim 15 wherein the ball is configured to rotate about an axis roughly parallel to the flight path throughout the flight while the tail portion remains substantially fixed with respect to the axis.

17. A method for manufacturing a throwing toy, the method comprising forming a ball, forming an elongate tail portion, and connecting the ball to the tail portion, wherein the ball and tail portion are formed at least partially from a foam material, and wherein the ball and tail portion are connected such that the ball and the tail portion can rotate relative to each other but are substantially prevented from moving translationally relative to each other.

18. The method of claim 17, wherein the step of connecting the ball to the tail portion includes the steps of providing a coupling having a socket and a shaft, the shaft having retaining structure; inserting a portion of the shaft into the socket such that the retaining structure of the shaft forms a locking connection with the socket, the locking connection allowing the shaft to rotate relative to the socket without substantially sliding along its axis of rotation; and attaching the coupling to the ball and tail portion such that one of the shaft and socket is non-rotatably connected to the tail portion and the ball and the tail portion can rotate relative to each other.

19. The method of claim 18, wherein the ball is elongate with tapered front and rear ends.

20. A method for manufacturing a throwing toy, the method comprising forming a ball, forming an elongate tail portion, forming a shaft, inserting the tail portion over the shaft, forming a receptor, forming the ball around the receptor, and inserting the shaft into the receptor so that the shaft is rotatable about its longitudinal axis and substantially locked in place against movement along its longitudinal axis.

21. The throwing toy of claim 7, wherein the retaining structure is disposed substantially within the ball.

* * * * *